US009068404B2

(12) United States Patent
Angelle et al.

(10) Patent No.: US 9,068,404 B2
(45) Date of Patent: Jun. 30, 2015

(54) FLOATING SPIDER

(75) Inventors: Jeremy Richard Angelle, Lafayette, LA (US); Robert Thibodeaux, Jr., Lafayette, LA (US); Donald E. Mosing, Lafayette, LA (US)

(73) Assignee: Frank's International, LLC, Houston, TX (US)

( * ) Notice: Subject to any disclaimer, the term of this patent is extended or adjusted under 35 U.S.C. 154(b) by 557 days.

(21) Appl. No.: 13/459,319

(22) Filed: Apr. 30, 2012

(65) Prior Publication Data

US 2012/0325498 A1 Dec. 27, 2012

Related U.S. Application Data

(60) Provisional application No. 61/481,217, filed on May 1, 2011.

(51) Int. Cl.

| | |
|---|---|
| ***E21B 19/18*** | (2006.01) |
| ***E21B 19/10*** | (2006.01) |
| ***E21B 19/24*** | (2006.01) |

(52) U.S. Cl.

CPC ..... *E21B 19/10* (2013.01); *E21B 19/24* (2013.01)

(58) Field of Classification Search

CPC ..... E21B 19/16; E21B 19/06; E21B 19/07; E21B 19/10; E21B 31/18; E21B 31/12

USPC ..... 166/380, 382, 77.51, 77.52, 77.53, 166/85.1, 75.14; 294/86.1, 86.12

See application file for complete search history.

(56) References Cited

U.S. PATENT DOCUMENTS

| | | | | |
|---|---|---|---|---|
| 4,133,398 | A | 1/1979 | Still | |
| 4,275,488 | A * | 6/1981 | Gray et al. | 294/102.2 |
| 5,335,756 | A * | 8/1994 | Penisson | 188/67 |
| 5,395,183 | A * | 3/1995 | Watkins | 405/195.1 |
| 5,848,647 | A * | 12/1998 | Webre et al. | 166/379 |
| 6,845,814 | B2 * | 1/2005 | Mason et al. | 166/75.14 |
| 6,892,835 | B2 | 5/2005 | Shahin et al. | |
| 7,143,849 | B2 * | 12/2006 | Shahin et al. | 175/423 |
| 7,686,088 | B2 * | 3/2010 | Shahin | 166/382 |
| 8,087,466 | B2 * | 1/2012 | Iversen | 166/358 |
| 2009/0056930 | A1 * | 3/2009 | Angelle et al. | 166/77.51 |
| 2012/0312553 | A1 * | 12/2012 | Mosing et al. | 166/380 |

OTHER PUBLICATIONS

International Search Report and Written Opinion from PCT/US2012/035750 dated Nov. 28, 2012 (8 pages).

* cited by examiner

*Primary Examiner* — Kenneth L Thompson
*Assistant Examiner* — Michael Wills, III
(74) *Attorney, Agent, or Firm* — Osha Liang LLP

(57) ABSTRACT

Apparatus and methods for engaging and gripping a tubular, with the apparatus including a sleeve having a body defining an internal chamber therein, with the sleeve configured to receive the tubular through the internal chamber. The apparatus may also include a laterally translatable spider disposed at least partially in the sleeve and including a bore to receive the tubular.

20 Claims, 7 Drawing Sheets

FLOATING SPIDER

This application claims priority to U.S. Provisional Patent Application Ser. No. 61/481,217, which was filed May 1, 2011. This priority application is hereby incorporated by reference in its entirety into the present application, to the extent that it is not inconsistent with the present application.

BACKGROUND

In various drilling and casing run-in applications, the tubular being lowered can move laterally with respect to the rig. Typically, the tubulars are suspended during run-in by an elevator attached to the rig, e.g., via bails extending from a top drive and/or traveling block. The elevator can swing via the bails; therefore, the elevator is able to move with the lateral movement of the tubular. However, the tubulars are also typically engaged by a spider flush-mounted or otherwise disposed on the rig floor in a rotary table. The spider is generally not suspended, and is typically not intended to be moved, in contrast to the elevator. Accordingly, lateral movement of the tubular generally translates to lateral movement with respect to the spider.

In such cases, the tubular can push against the spider, inducing a bending moment on the tubular, which can damage the tubular and/or other components of the rig. Moreover, even if the tubular does not damage itself or other components, it may remain off-center in the spider when the spider is needed to engage the tubular. Accordingly, the slips or bushings of the spider are caused to non-uniformly engage the tubular, since, due to the eccentric relationship between the spider and the tubular, some of the slips are positioned closer to the tubular than others. As such, the spider may attempt to bring the tubular back into alignment, which can induce bending moments on the tubular, as the inertia of the tubing resists the centering movement. Furthermore, especially for pneumatic spiders, the spider may be incapable of providing sufficient radial force so as to center the tubular. Accordingly, the tubular may be incompletely engaged by the spider, which can lead to the spider failing to adequately support the tubular, allowing the entire string to drop uncontrolled into the hole.

What is needed then are apparatus and methods for gripping a tubular with a spider, despite lateral movement of the tubular across a range of positions, while still enabling the spider to engage and support the string of tubulars.

SUMMARY

Embodiments of the disclosure may provide an exemplary floating spider assembly for engaging a tubular. The floating spider may include a sleeve having a body defining an internal chamber therein, with the sleeve being configured to receive the tubular through the internal chamber. The floating spider may also include a laterally translatable spider disposed at least partially in the sleeve and including a bore to receive the tubular.

Embodiments of the disclosure may also provide an exemplary apparatus for supporting a tubular. The apparatus may include a tubular gripping device defining a bore for receiving the tubular and one or more gripping members configured to selectively engage and support the tubular. The apparatus may also include a sleeve including a top, a bottom, and a body extending therebetween. The top and bottom each define a bore, with the bore of the top and the bore of the bottom being substantially concentric. The body defines an internal chamber sized to receive the tubular gripping device at least partially therein and to provide a radial clearance between the tubular gripping device and the body. The tubular gripping device is free to translate in a lateral direction relative the sleeve such that the bore of the tubular gripping device is configured to be moved off-center with respect to the bore of the top and the bore of the bottom.

Embodiments of the disclosure may further provide an exemplary method for gripping a tubular. The method may include receiving a spider in a sleeve, and receiving the tubular through a bore in the spider and through the sleeve. The method may also include gripping the tubular with the spider, and allowing the spider to translate laterally with respect to the sleeve.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
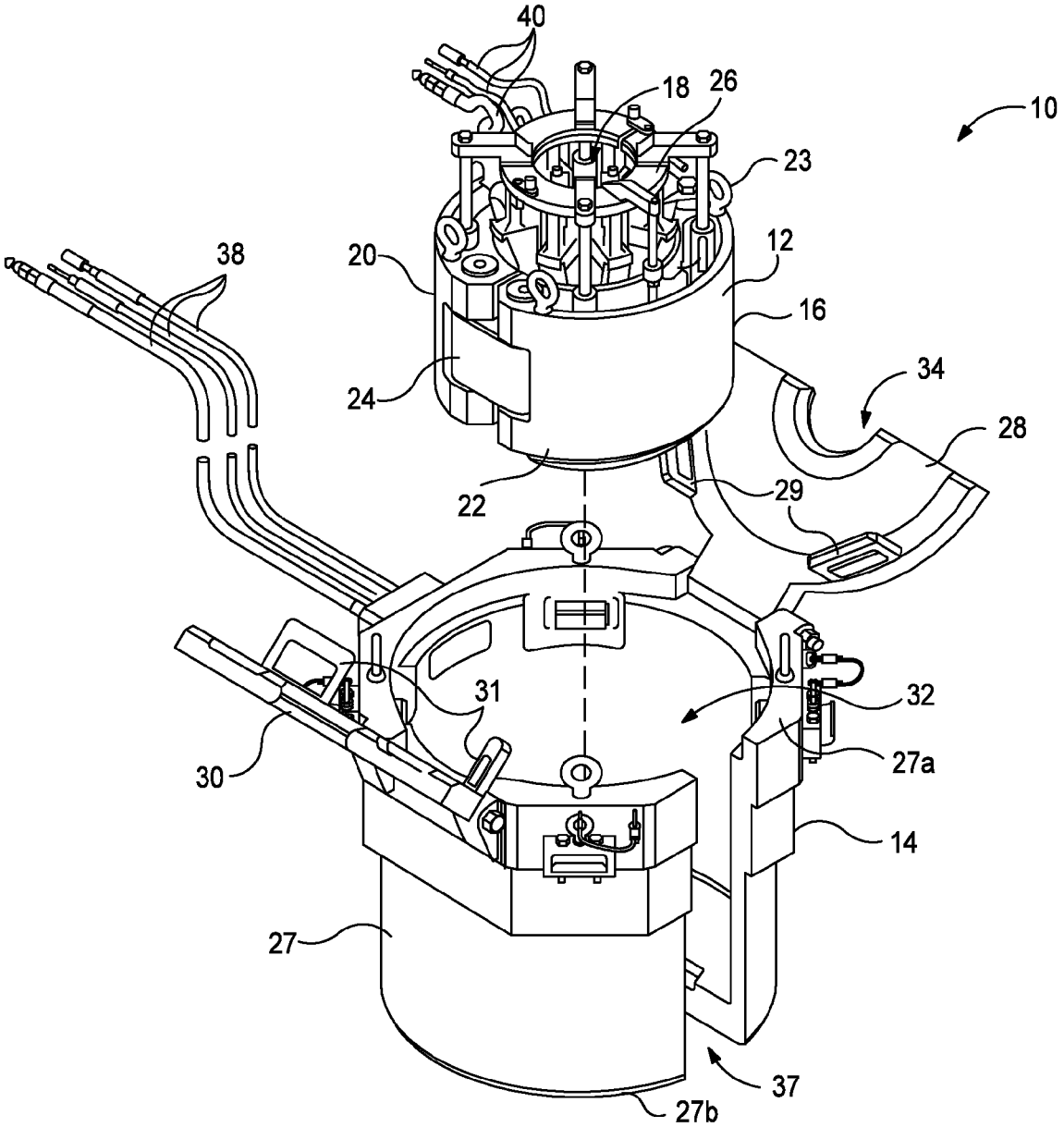
FIG. 1 illustrates a perspective, exploded view of an exemplary floating spider assembly, according to an aspect of the disclosure.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates a perspective, exploded view of a floating spider assembly 10, according to an exemplary embodiment described. In general, the floating spider assembly 10 includes a tubular engagement device or spider 12, which is disposed in a sleeve 14. The spider 12 is configured to engage a tubular (not shown) and to translate laterally within the sleeve 14. As such, the spider 12 "floats" in the sleeve 14, such that it centers itself on the tubular, despite eccentric positioning of the tubular with respect to the sleeve 14. Further, the floating spider assembly 10 includes one or more rotation-limiting structures, such as lugs 50, 52 (FIG. 6), 104, 106 (FIGS. 8 and 9), and/or links 200, 202 (FIG. 10). These structures are configured to allow the lateral translation of the spider 12 relative to the sleeve 14, but generally constrain the rotation of the spider 12 relative to the sleeve 14, thereby avoiding damaging connections to the spider 12, e.g., pneumatic or hydraulic lines 38, 40. Accordingly, the floating spider assembly 10 may advantageously prevent or reduce bending moments on the tubular and/or the spider 12 incompletely gripping the tubular.

Referring now to the illustrated embodiments in greater detail, FIG. 1 further illustrates the spider 12 aligned with the sleeve 14, for positioning therein. The sleeve 14, in turn, may be received in a rotary table (not shown) and flush-mounted or otherwise mounted to the rig floor. The spider 12 includes a main body 16 in which a bore 18 is defined for receiving a tubular therethrough. Although not illustrated in detail, the spider 12 also includes one or more gripping members positioned in the bore 18, such as one or more bushings, bushing segments, wedges, slips, shoulders, dies, or other structures known in the art to selectively engage (i.e., when desired by the operator) the tubular, and/or an upset thereof. The body 16 of the spider 12 may be split, as shown, such that it defines two generally arcuate segments 20, 22. The segments 20, 22 may be coupled together via a hinge 24 on one end and a latch (not shown) on an opposing end. Such hinged connection is merely one embodiment among many contemplated herein and the use of other releasable connections, whether for a split body 16, as shown, or an integral body, may be employed without departing from the scope of this disclosure. The spider 12 further includes a timing bar 26 that facilitates moving the gripping members into engagement with the tubular, as is known in the art. In at least one embodiment, lift connectors 23 are coupled to the body 16 and are configured to assist in the positioning of the spider 12 in the sleeve 14.

Turning now to the sleeve 14, the sleeve 14 includes a generally cylindrical body 27 having axial ends, for example, a top 27*a* and a bottom 27*b*. Top guides 28, 30 may be pivotally mounted to the body 27, proximal the top 27*a* as shown, for example, such that the top guides 28, 30 may be movable between a closed position to enclose an internal chamber 32 defined in the body 27 and an open position to provide access to the internal chamber 32. In other embodiments, the top guides 28, 30 may instead or additionally be non-pivotally fastened to the top 27*a*, or to another area of the body 27 and/or otherwise configured for removal. Further, the top guides 28, 30 may be generally semi-circular, and may each include a cut-out 34, 36 (cut-out 36 is visible in FIG. 3). In various embodiments, the cut-outs 34, 36 may be semi-circular to define a bore as described below; however, the cut-outs 34, 36 may be any other shape desired. Handles 29, 31 may be provided on the inside of the top guides 28, 30 to facilitate articulation of the top guides 28, 30 between open and closed positions. In various embodiments, multiple additional top guides (not shown) may be employed, such that the top guides 28, 30 and others form smaller fractions of a circle.

The sleeve 14 may define a slot 37 extending longitudinally and at least partially therethrough. The slot 37 may also extend radially along the bottom 27*b* of the body 27, toward the center thereof. The slot 37 may communicate with a bore (not visible) formed in the bottom 27*b*, as will be described in greater detail below.

In some embodiments, the spider 12 may be hydraulically or pneumatically operated. Accordingly, fluid supply lines 38 may be fed through the sleeve 14 and connected with supply lines 40 extending to the spider 12. In various embodiments, the supply lines 38, 40 may coupled together via one or more intermediary connections (not shown) defined through the sleeve 14; however, in other embodiments the supply lines 38, 40 may be coupled directly to each other, extending through one or more apertures (none shown) defined through the sleeve 14.

Figure 2:
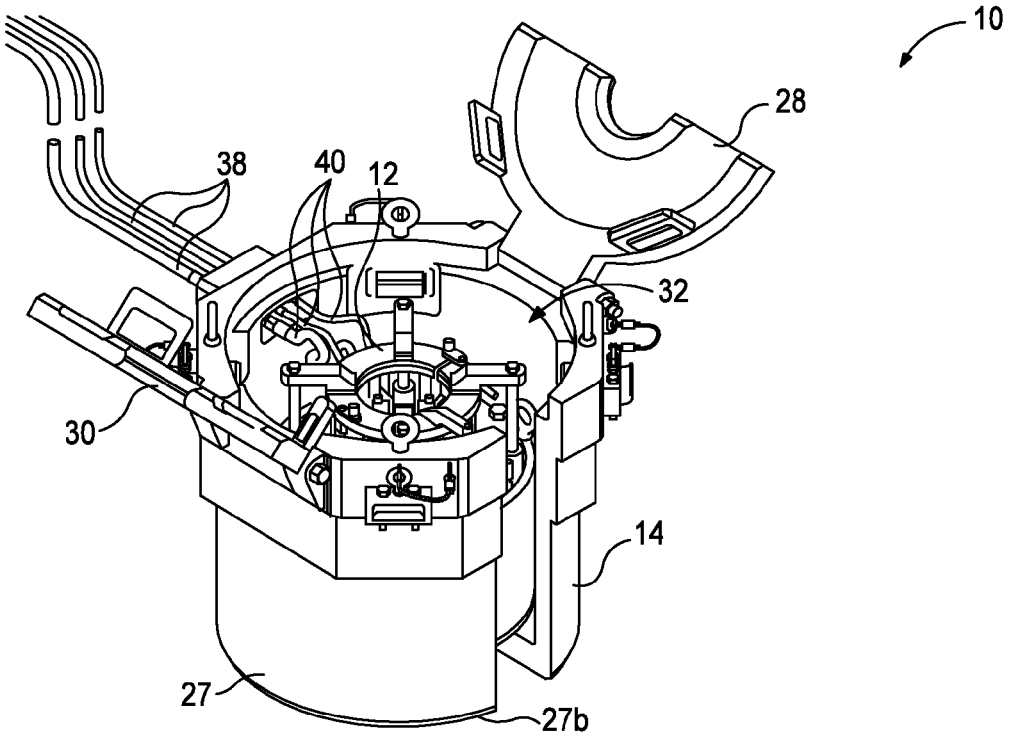
FIG. 2 illustrates a perspective view of the floating spider assembly with top guides opened, according to an aspect of the disclosure.
Figure 3:
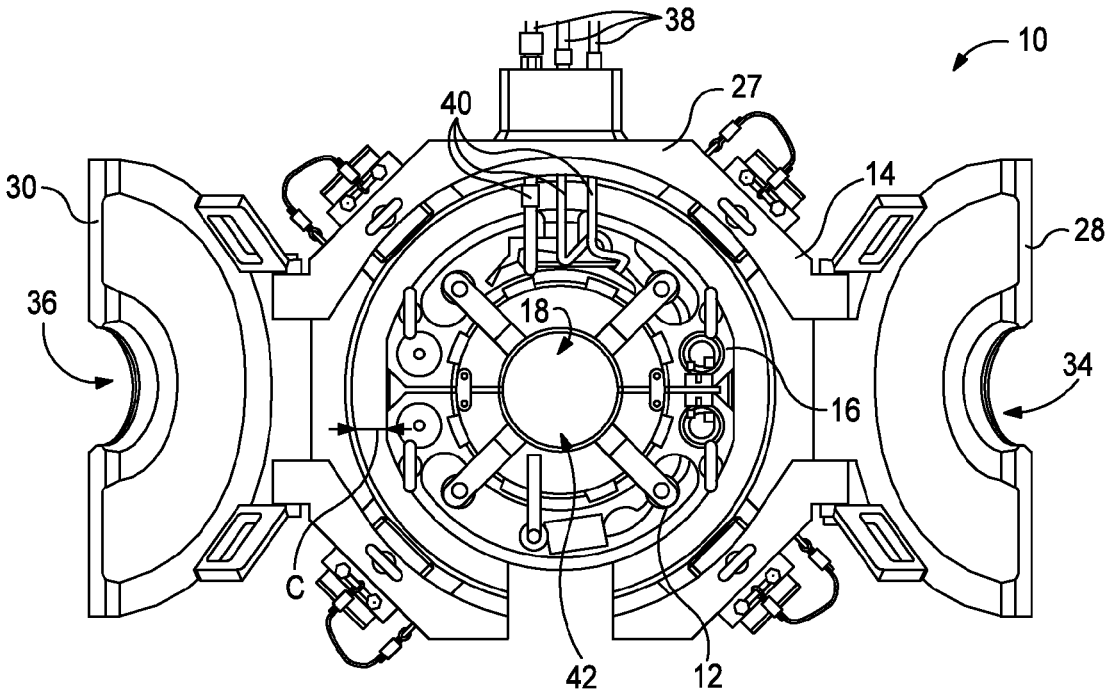
FIG. 3 illustrates a top view of the floating spider assembly, according to an aspect of the disclosure.

FIGS. 2 and 3 illustrate a perspective view and a top view, respectively, of the floating spider assembly 10, with the spider 12 being disposed in the sleeve 14. As shown, the top guides 28, 30 may be opened to receive the spider 12, and the spider 12 may be lowered into the internal chamber 32 defined in the sleeve 14. The top guides 28, 30 may be closed during normal operation of the floating spider assembly 10 and/or may be opened to facilitate maintenance and/or removal of the spider 12 from the sleeve 14. Once the spider 12 is positioned in the sleeve 14 (or during such positioning) the supply lines 38, 40 may be fluidly coupled together to provide the exemplary pneumatic or hydraulic connection for actuation of the spider 12.

As shown in FIG. 3, the bore 18 in the spider 12 generally aligns with a bore 42 in the bottom 27*b* of the body 27 of the sleeve 14, with the bore 42 communicating with the internal chamber 32 (FIG. 2). The bore 42 is configured to receive a tubular therethrough, but is generally sized to be larger than the bore 18 through the spider 12. Further, the diameter of the bore 42 may be approximately equal to a diameter of the bore formed by the cut-outs 34, 36 when the top guides 28, 30 are closed.

The outer diameter of the body 16 of the spider 12 is smaller than the inner diameter of the body 27 of the sleeve 14. Accordingly, a floating clearance C is provided and defined between the outer diameter of the body 16 of the spider 12 and the inner diameter of the body 27 of the sleeve 14. The spider 12 may be generally free from constraint to move laterally within the sleeve 14 across such clearance C, but may be constrained from rotation, for example, to protect the connection between the supply lines 38, 40, and/or other internal connections. In other embodiments, the spider 12 may be provided with end ranges for lateral translation, so as to prevent the spider 12 from contacting the sleeve 14; however, in other embodiments, as illustrated, such constraint may be unnecessary and omitted. As the spider 12 floats (i.e., translate laterally) in the sleeve 14, it will be appreciated that the bores 18, 42 may be generally concentric, but the positioning of the bore 18 may shift, such that the alignment of the bores 18, 42 becomes eccentric, as may be advantageous for handling an off-centered tubular.

Figure 4:
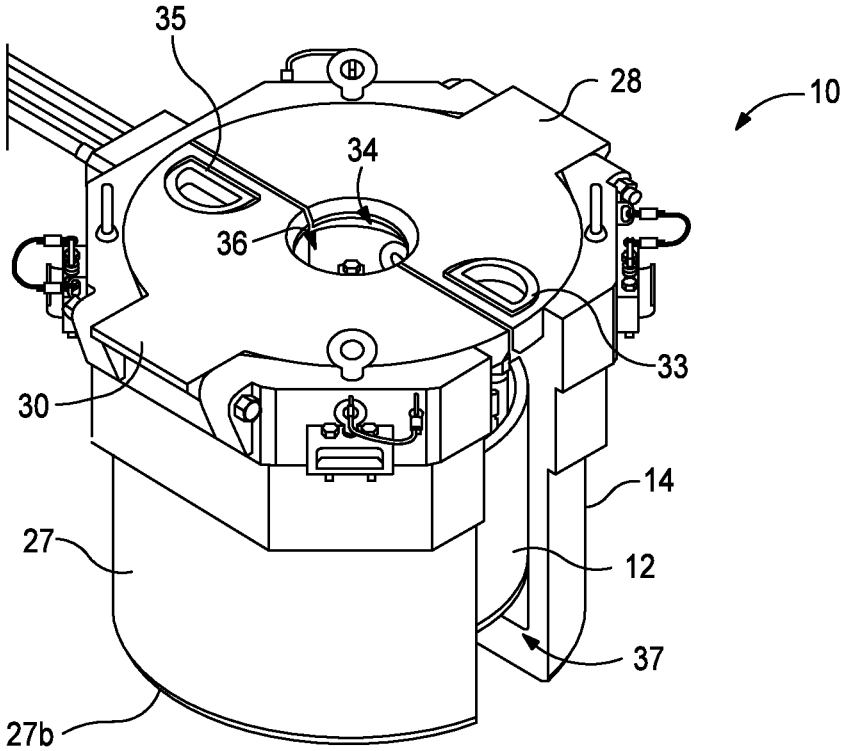
FIG. 4 illustrates a perspective view of the floating spider assembly with the top guides closed, according to an aspect of the disclosure.

FIG. 4 illustrates a perspective view of the floating spider assembly 10, with the top guides 28, 30 being closed. As shown, the cut-outs 34, 36 align to form a bore through the top guides 28, 30 and in communication with the internal chamber 32. The bore formed by the cut-outs 34, 36 may generally align with and have approximately the same diameter as the bore 42 (FIG. 3) in the bottom 27*b* of the body 27. As also shown, the slot 37 may provide a channel though the sleeve 14, such that access to the spider 12, even when the top guides 28, are closed, is provided. This may enable the spider 12 to be lifted out of or lowered into the sleeve 14 via engagement with any suitable lifting mechanism through the slot 37. Additionally, second handles 33, 35 may be provided for opening the top guides 28, 30.

Figure 5:
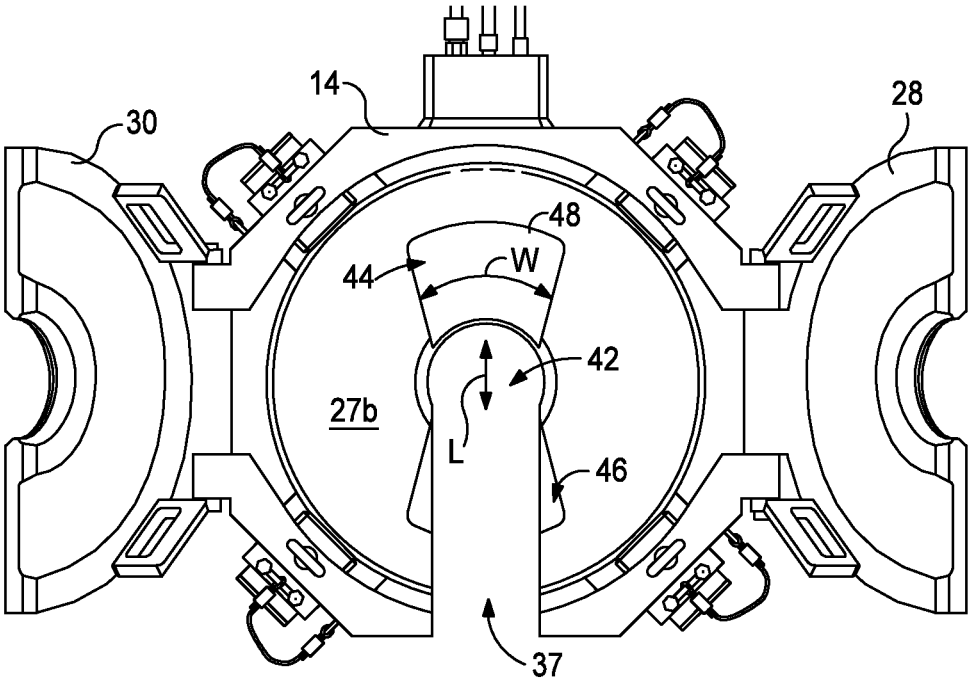
FIG. 5 illustrates a top view of an exemplary sleeve for the floating spider assembly, according to an aspect of the disclosure.

FIG. 5 illustrates a top view of the sleeve 14, with the top guides 28, 30 once again opened, according to an exemplary embodiment described. As shown, the slot 37 proceeds radially-inward along the bottom 27*b*, toward and, for example, into communication with the bore 42. In other embodiments, however, the slot 37 may stop prior to meeting the bore 42.

Pockets 44, 46 are also defined in the bottom 27*b*, and may extend radially from the bore 42. At least one of the pockets 44, 46 may overlap the slot 37; however, in other embodiments, the pockets 44, 46 may not overlap the slot 37 and, accordingly, may be angularly displaced from the slot 37. Further, the pockets 44, 46 may be wedge-shaped, such that a circumferential width W of each of the pockets 44, 46 increases proceeding radially-outward from the bore 42. The radially-outer extent 48 of the pockets 44, 46 may be arc-shaped, as shown, but in other embodiments may be partially or completely flat instead. The pockets 44, 46 may extend partially or entirely through the bottom 27*b*.

Figure 6:
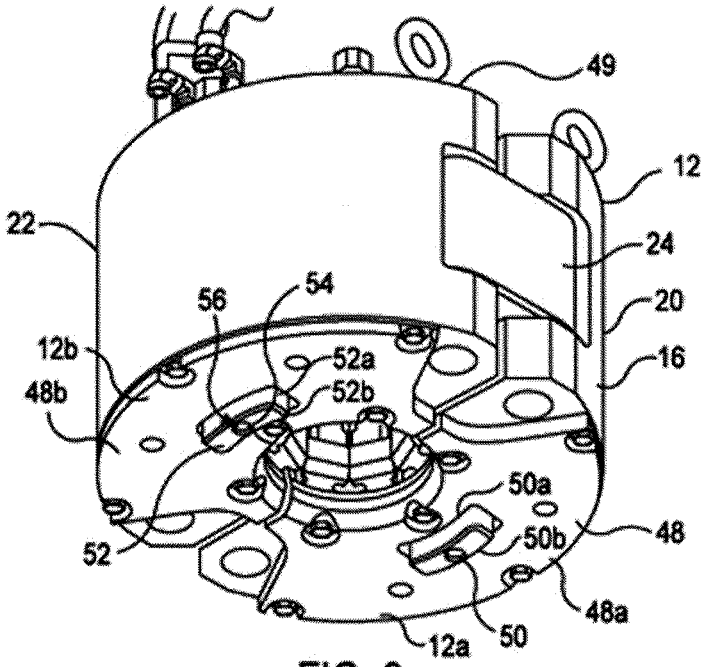
FIG. 6 illustrates a perspective view of an exemplary spider of the floating spider assembly, according to an aspect of the disclosure.

With continuing reference to FIG. 5, FIG. 6 illustrates a perspective view of the spider 12, showing a bottom 48 of the body 16 thereof, according to an exemplary embodiment described. The bottom 48 may include one or more plates 48*a,b*, through which lugs 50, 52 extend. In the illustrated embodiment, two plates 48*a,b* are provided, one for each segment 20, 22 of the body 16, so as not to interfere with the separation of the segments 20, 22 via the hinge 24. However, in various embodiments, one, three, or more plates may be employed without departing from the scope of this disclosure. The lugs 50, 52 may be integral with, welded to, or, as shown, fastened to the body 16, for example.

The lugs 50, 52 may extend axially-downward from the bottom 48 of the spider 12 and are sized to be received into the pockets 44, 46 of the sleeve 14. As such, the lugs 50, 52 received in the pockets 44, 46 may be configured to constrain rotation of the spider 12 relative the sleeve 14, as will be described in greater detail below. Furthermore, although two lugs 50, 52 are shown, it will be appreciated that one, three, or more lugs may be employed without departing from the scope of this disclosure. In such embodiments, the number of pockets 44, 46 may be commensurate with the number of lugs 50, 52.

In various embodiments, the lugs 50, 52 may be cylindrical, polygonal, or any other suitable shape. The lugs 50, 52 may each have a root 50*a*, 52*a*, and a tip 50*b*, 52*b*, respectively, with the roots 50*a*, 52*a* being proximal the body 16 and the tips 50*b*, 52*b* being distal therefrom. In an exemplary embodiment, as shown, the roots 50*a*, 52*a* are defined as the area of the lugs 50, 52, respectively, where the lugs 50, 52 meet the plates 48*a,b*; however, it will be appreciated that if the plates 48*a,b* are omitted, the roots 50*a*, 52*a* may be directly adjacent any structure defining the bottom 48 of the body 16. The lugs 50, 52 may be fastened to the body 16 via a fastener 54 received through a bore 56. In other embodiments, however, the lugs 50, 52 may be integral with the body 16 or may be coupled to the body 16 using any suitable device and/or process, such as by welding, brazing, or the like.

The pockets 44, 46 may be of sufficient depth such that the lugs 50, 52 are slidable therein substantially from the root 50*a*, 52*a* to the tip 50*b*, 52*b*. Furthermore, the circumferential extent of the lugs 50, 52 may be smaller than the circumferential width W of the pockets 44, 46, such that the lugs 50, 52 are movable rotationally over a short range in the pockets 44, 46, with engagement between sides of the lugs 50, 52 and the sides of the pockets 44, 46 defining end ranges for the rotational movement of the spider 12 relative to the sleeve 14. In various embodiments, the range of rotation may be less than about 1°, about 2°, about 3°, about 5°, about 10°, or more. The lugs 50, 52 fitting loosely into the pockets 44, 46 may allow some play in the rotational position of the spider 12 with respect to the sleeve 14, but may still prevent damage to connections to the spider 12, for example, the supply lines 38, 40 (e.g., FIG. 2). Although not shown, it will be appreciated that in various embodiments, the lugs 50, 52 may be formed on a top 49 of the body 16 of the spider 12 and may extend axially upward therefrom. Accordingly, the pockets 44, 46 may be formed in the top guides 28, 30. Moreover, embodiments including lugs such as lugs 50, 52 disposed on the bottom 48 and the top 49 of the spider 12 are expressly contemplated herein.

Figure 7:
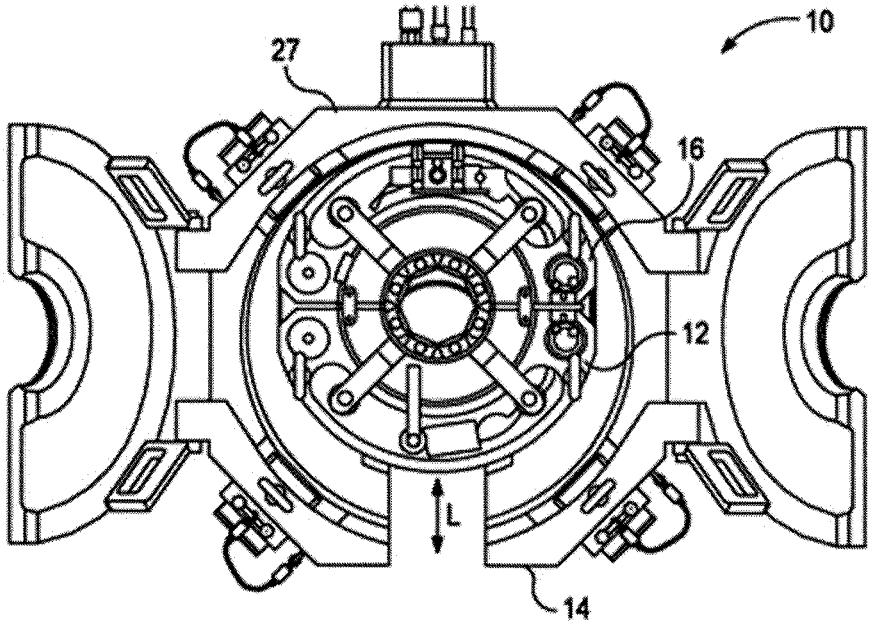
FIG. 7 illustrates a top view of the floating spider assembly, with the spider shifted off-center in the sleeve, according to an aspect of the disclosure.

With continuing reference to FIG. 6, FIG. 7 illustrates a top view of the floating spider assembly 10 having been shifted laterally in the direction L. The lugs 50, 52 (FIG. 6), and thus the spider 12, are movable over a wide range in the lateral direction L (also shown in FIG. 5) in the pockets 44, 46 (FIG. 5). Indeed, in some embodiments, the lugs 50, 52 may not impede the lateral movement in direction L of the spider 12 in the sleeve 14, with such lateral movement of the spider 12 being constrained only by engagement with the body 27 of the sleeve 14. In other embodiments, however, the lugs 50, 52 may engage the sides of the pockets 44, 46 (FIG. 5), prior to engagement with the body 27 of the sleeve 14, thereby preventing contact between the side of body 16 of the spider 12 and the body 27 of the sleeve 14.

Referring now to FIGS. 1-7, in exemplary operation, the floating spider assembly 10 receives a tubular through the bore defined by the cut-outs 34, 36 of the top guides 28, 30, through the bore 18 of the spider 12, and through the bore 42 at the bottom 27*b* of the body 27 of the sleeve 14. Generally, the diameter of the bore 42 and the bore defined by the cutouts 34, 36 is greater than that of the tubular, providing a clearance between the sleeve 14 and the tubular that avoids inducing a bending moment on the tubular. Further, the top guides 28, 30, guide the tubular to the bore 18 of the spider 12. The spider 12 receives the tubular through the bore 18 and with its gripping members (not shown) engages the tubular, thereby supporting the tubular. Lateral forces causing the centerline of the tubular to deviate from the center of the bore 42, and the center of the bore defined by the cutouts 34, 36, is compensated for by the spider 12 shifting, sliding, or otherwise translating within the sleeve 14 to the extent allowed by the pockets 44, 46. Such translation may occur while the tubular is supported by the spider 12 or while the tubular is lowered through the bore 18 via an elevator (not shown). Further, the spider 12 is prevented from rotating across more than a tolerated angle by the lugs 50, 52 engaging the pockets 44, 46. As such, the spider 12 centers itself relative to the tubular, to the extent allowed in the sleeve 14 on the tubular, avoiding the creation of bending moments and/or damage to the tubular or the spider 12.

Figure 8:
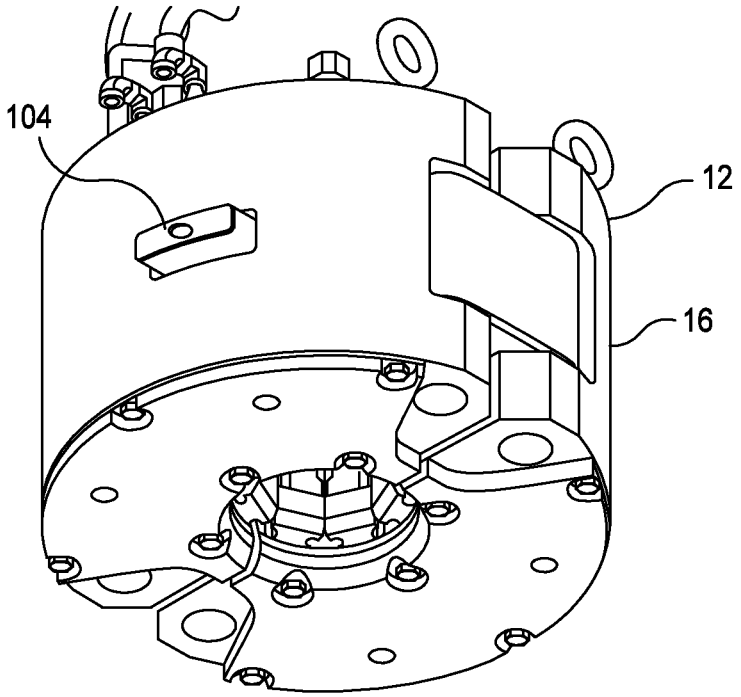
FIG. 8 illustrates another embodiment of the spider, according to an aspect of the disclosure.
Figure 9:
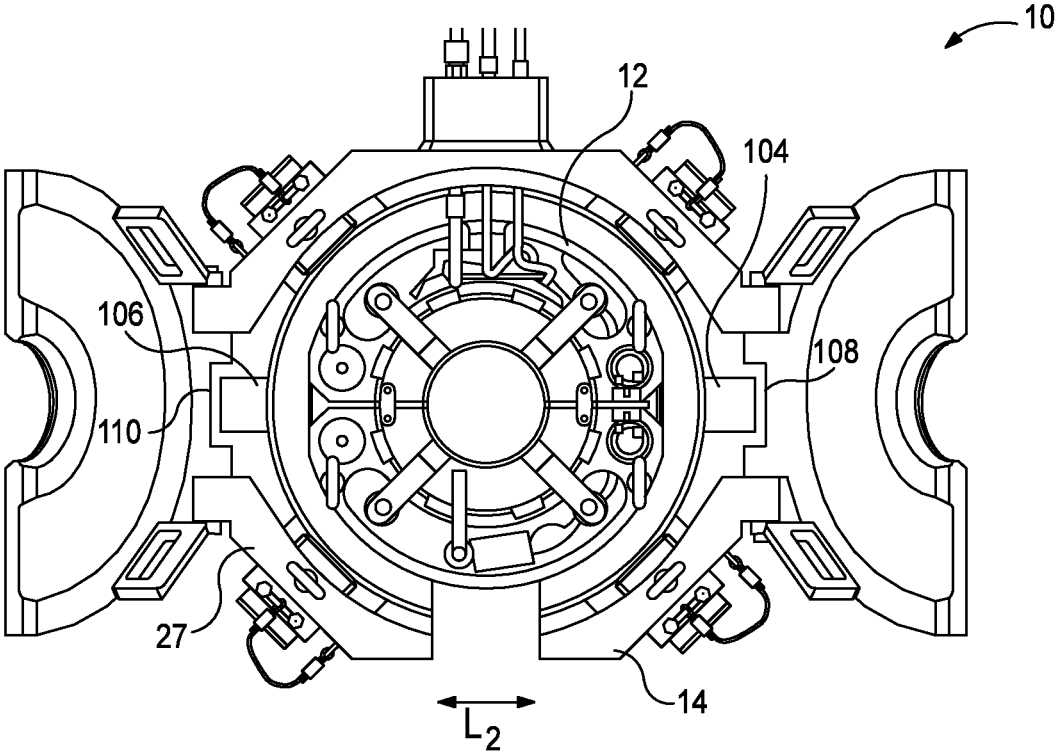
FIG. 9 illustrates a perspective view of another embodiment of the spider for the floating spider assembly, according to an aspect of the disclosure.
Figure 10:
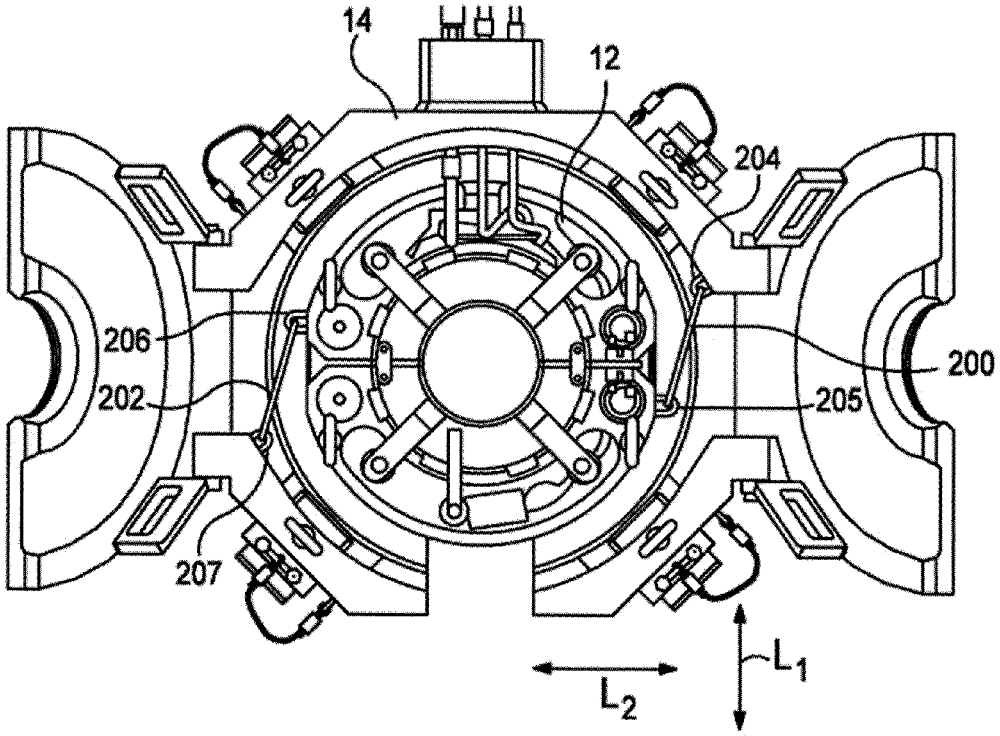
FIG. 10 illustrates a top view of yet another embodiment of the floating spider assembly, according to an aspect of the disclosure.

FIG. 8 illustrates a perspective view of another embodiment of the spider 12, and FIG. 9 illustrates a top view of the floating spider assembly 10, employing the spider 12 of FIG. 8. As shown, the spider 12 may be generally similar in structure and operation as described above, except that the spider 12 shown in FIG. 8 includes lugs 104, 106 extending radially from the body 16 in lieu of the lugs 50, 52 (FIG. 6) extending downward therefrom. The lugs 104, 106 may be integral with the body 16, may extend through a plate cladding the body (not shown), and/or may be fastened or otherwise connected to the body 16 via any suitable device or process. In various embodiments, however, the spider 12 may include both the lugs 50, 52 extending upward and/or downward and the lugs 104, 106 extending radially. The lugs 104, 106 may be received into pockets 108, 110 (FIG. 9) defined in and/or through the body 27 of the sleeve 14 between the top 27*a* and bottom 27*b* (e.g., FIG. 1). The lugs 104, 106 may thus engage the pockets 108, 110 to prevent more than a small amount of rotation of the spider 12 with respect to the sleeve 14. For example, the range of rotation allowed for the spider 12 may be less than about less than about 1°, about 2°, about 3°, about 5°, about 10°, or more. On the other hand, the pockets 108, 110 may be sufficiently deep in the sleeve 14 (and/or extend entirely through the body 27 of the sleeve 14), such that the spider 12 is movable laterally, as shown schematically by arrow $L_2$.

Although the lugs 50, 52 and 104, 106 are described above and illustrated as being part of the spider 12 and extending from the body 16 thereof, it will be appreciated that they may instead or additionally be part of the sleeve 14 and extend therefrom into the internal chamber 32 (FIGS. 1 and 2). In such case, the pockets 44, 46 and/or 108, 110 may be defined in the body 16 of the spider 12.

FIG. 10 illustrates yet another embodiment of the floating spider assembly 10, according to the present disclosure. The floating spider assembly 10, in addition to or in lieu of the lugs 50, 52 (and/or lugs 104, 106), may include links 200, 202. Each link 200, 202 may be coupled on one side to the spider 12 and on the other side to the sleeve 14. Although two links 200, 202 are illustrated, it will be appreciated that one link, three links, or more may be employed without departing from the scope of this disclosure. Further, the links 200, 202 may be coupled to the sleeve 14 and/or spider 12 via eyes 204, 205, 206, 207, as schematically illustrated in the figure; however, it will be appreciated that the eyes 204-207 may be recessed into the spider 12 and/or sleeve 14, as desired, to permit the maximum amount of freedom for relative movement between the spider 12 and the sleeve 14.

Further, the links 200, 202 may be flexible or rigid. For example, rigid links 200, 202 may be pivotally-connected to both the spider 12 and the sleeve 14, and may extend in opposite directions tangent the spider 12, thereby allowing the spider 12 to move along direction $L_2$, but generally preventing the spider 12 from moving along direction $L_1$, for example, and limiting rotation relative the sleeve 14. In another embodiment, the links 200, 202 may be lines (e.g., cables, chains, etc). Accordingly, the links 200, 202 may be tensioned or may provide slack to enable the spider 12 to rotate a small amount, for example, as defined above, relative the sleeve 14. Additionally, slack links 200, 202 may be sized to allow the spider 12 to translate in either or both lateral directions $L_1$, $L_2$. In other embodiments, the links 200, 202 may be springs, which are loaded to provide resistance to rotation and/or lateral movement, thereby allowing the spider 12 to translate and/or rotate, but biasing the spider 12 toward being concentric with the sleeve 14.

Figure 11:
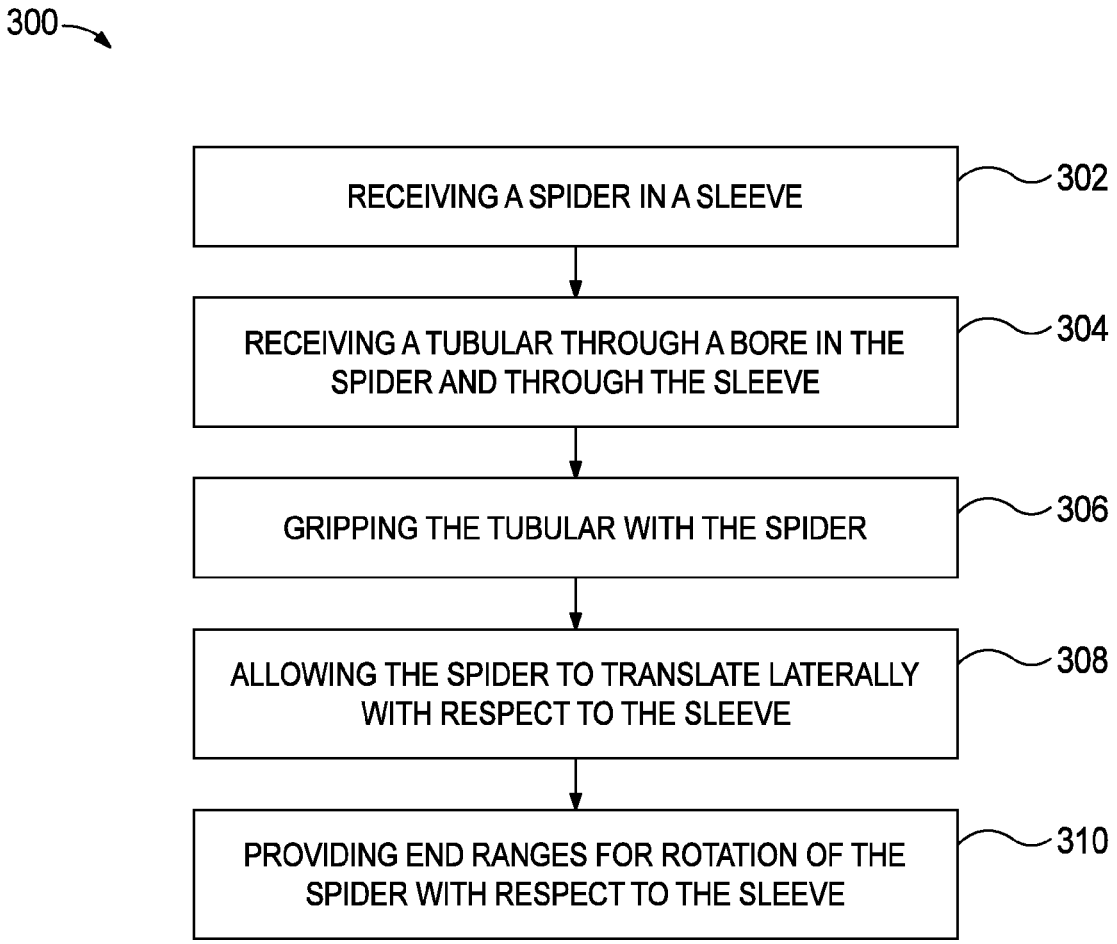
FIG. 11 illustrates a flowchart of an exemplary method for gripping a tubular, according to an aspect of the disclosure.

FIG. 11 illustrates a flowchart of an exemplary method 300 for gripping a tubular. The method 300 may proceed by, for example, operation of the floating spider assembly 10 described above with reference to any one or more of FIGS. 1-10 and thus may best be understood with reference thereto. The method 300 may include receiving a spider in a sleeve, as at 302. In at least one embodiment, receiving the spider at 302 includes receiving lugs of at least one of the spider and the sleeve into pockets defined in at least one of the sleeve and the spider.

The method 300 may also include receiving the tubular through a bore in the spider and through the sleeve, as at 304. In at least one embodiment, receiving the tubular at 304 includes receiving the tubular through a top guide coupled to the sleeve and through a bore defined in a bottom of the sleeve. In such an embodiment, receiving the spider in the sleeve at 302 may include opening the top guides. The method 300 may further include gripping the tubular with the spider, as at 306, for example, with one or more slips, bushings, wedges, dies, shoulders, or other gripping members thereof. The method 300 may also include allowing the spider to translate laterally with respect to the sleeve, as at 308. For example, in embodiments including lugs and pockets, the lugs may be allowed to slide relative the pockets.

Additionally, the method 300 may also include providing end ranges for rotation of the spider with respect to the sleeve, as at 310. Further, the end ranges may define a range of rotation that is less than about 30 degrees with the end ranges. Further, providing end ranges for rotation at 310 may further include engaging at least one of the lugs against a side of at least one of the pockets. In other embodiments, however, providing the end ranges at 310 may include engaging one or more links between the spider and the sleeve.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A floating spider assembly for engaging a tubular, comprising:

a sleeve having a body defining an internal chamber therein, the sleeve configured to receive the tubular through the internal chamber; and a laterally translatable spider disposed at least partially in the sleeve and including a bore to receive the tubular, wherein the spider is coupled to the sleeve such that the spider is laterally translatable relative to the sleeve.

2. The floating spider assembly of claim 1, wherein the spider includes a lug extending therefrom and the sleeve includes a pocket defined therein, the pocket configured to slidably receive the lug.

3. The floating spider assembly of claim 2, wherein the lug is slidable in the pocket such that lateral translation of the spider relative to the sleeve in at least one lateral direction is unrestricted by the lug in the pocket.

4. The floating spider assembly of claim 3, wherein the lateral translation of the spider in the at least one lateral direction is constrained by a main body of the spider contacting a side of the sleeve.

5. The floating spider assembly of claim 2, wherein the lug extends at least one of axially and radially-outward from a main body of the spider.

6. The floating spider assembly of claim 1, wherein the sleeve includes a lug extending therefrom and the spider includes a pocket defined therein, the pocket being configured to slidably receive the lug.

7. The floating spider assembly of claim 1, further comprising one or more links coupled to the spider and to the sleeve, such that the spider is constrained from rotation but allowed to translate laterally.

8. An apparatus for supporting a tubular, comprising:

a tubular gripping device defining a bore for receiving the tubular and one or more gripping members configured to selectively engage and support the tubular; and a sleeve including a top, a bottom, and a body extending therebetween, the top and bottom each defining a bore, the bore of the top and the bore of the bottom being substantially concentric, the body defining an internal chamber sized to receive the tubular gripping device at least partially therein and to provide a radial clearance between the tubular gripping device and the body, the tubular gripping device being free to translate in a lateral direction relative the sleeve such that the bore of the tubular gripping device is configured to be moved off-center with respect to the bore of the top and the bore of the bottom.

9. The apparatus of claim 8, wherein the tubular gripping device includes one or more lugs extending therefrom and configured to be received into one or more pockets defined in the sleeve.

10. The apparatus of claim 9, wherein the one or more lugs have a circumferential extent that is less than a circumferential width of the one or more pockets, such that the tubular gripping device is rotatable with respect to the sleeve.

11. The apparatus of claim 10, wherein end ranges for rotation of the tubular gripping device relative to the sleeve are provided by circumferential engagement of the one or more lugs with the corresponding one or more pockets, wherein the end ranges define a range of rotation for the tubular gripping device, the range of rotation being less than about 30 degrees.

12. The apparatus of claim 9, wherein the one or more lugs extend at least one of upward and downward from a body of the tubular gripping device and the pocket is defined in at least one of the top and the bottom of the sleeve.

13. The apparatus of claim 9, wherein the one or more lugs extend radially-outward from a body of the tubular gripping device.

14. The apparatus of claim 8, wherein the sleeve includes one or more lugs extending at least one of radially inward from the body of the sleeve and upward from the bottom of the sleeve, the one or more lugs slidably received in one or more pockets defined in the tubular gripping device.

15. The apparatus of claim 8, further comprising one or more links extending between the tubular gripping device and the sleeve, the one or more links allowing lateral translation of the spider relative to the sleeve and providing end ranges for rotation of the tubular gripping device relative to the sleeve.

16. A method for gripping a tubular, comprising:

receiving a spider in a sleeve;

receiving the tubular through a bore in the spider and through the sleeve;

gripping the tubular with the spider; and laterally translating the spider with respect to the sleeve.

17. The method of claim 16, wherein:

receiving the spider in the sleeve comprises receiving lugs of at least one of the spider and the sleeve into pockets defined in the other of at least one of the sleeve and the spider; and Allowing the spider to translate laterally translating the spider includes allowing the lugs to slide relative to the pockets.

18. The method of claim 16, further comprising providing end ranges for rotation of the spider with respect to the sleeve.

19. The method of claim 18, wherein providing end ranges for rotation comprises engaging at least one of the lugs against a side of at least one of the pockets.

20. The method of claim 18, wherein providing the end ranges for rotation of the spider includes engaging one or more links between the spider and the sleeve.

* * * * *